US011427016B2

(12) United States Patent
Okeguchi et al.

(10) Patent No.: US 11,427,016 B2
(45) Date of Patent: Aug. 30, 2022

(54) LIQUID DISCHARGE APPARATUS

(71) Applicant: Ricoh Company, Ltd., Tokyo (JP)

(72) Inventors: Muneyuki Okeguchi, Kanagawa (JP); Taku Hatakeyama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 297 days.

(21) Appl. No.: 16/574,649

(22) Filed: Sep. 18, 2019

(65) Prior Publication Data

US 2020/0094582 A1 Mar. 26, 2020

(30) Foreign Application Priority Data

Sep. 21, 2018 (JP) ..... JP2018-176949

(51) Int. Cl.

| | |
|---|---|
| ***B41J 3/407*** | (2006.01) |
| ***B41J 11/00*** | (2006.01) |
| ***B41M 7/00*** | (2006.01) |
| *B41J 11/06* | (2006.01) |

(52) U.S. Cl.

CPC ..... *B41J 3/4078* (2013.01); *B41J 11/0024* (2021.01); *B41J 11/00244* (2021.01); *B41M 7/009* (2013.01); *B41J 11/06* (2013.01)

(58) Field of Classification Search

CPC .... B41J 3/4078; B41J 11/002; B41J 11/0024; B41J 11/00244; B41J 11/06; B41M 7/009

See application file for complete search history.

(56) References Cited

U.S. PATENT DOCUMENTS

| | | | | |
|---|---|---|---|---|
| 4,751,528 | A * | 6/1988 | Spehrley, Jr. | B41J 11/02 347/18 |
| 5,249,255 | A * | 9/1993 | Fuqua | B41F 15/12 101/115 |
| 5,570,118 | A * | 10/1996 | Rezanka | B41J 3/543 347/43 |
| 5,831,655 | A * | 11/1998 | Asawa | B41J 11/00244 347/89 |
| 8,911,074 | B2 * | 12/2014 | Ohta | B41M 3/008 347/102 |
| 9,346,300 | B2 * | 5/2016 | Suzuki | B41J 2/01 |
| 10,981,398 | B2 * | 4/2021 | Tamaki | B41J 2/01 |
| 2007/0052786 | A1 * | 3/2007 | Nakazawa | B41J 11/00214 347/102 |

(Continued)

FOREIGN PATENT DOCUMENTS

| | | | | |
|---|---|---|---|---|
| JP | 2014233879 | A * | 12/2014 | B41J 3/60 |
| JP | 2015-183331 | A | 10/2015 | |

(Continued)

*Primary Examiner* — Jill E Culler

(74) *Attorney, Agent, or Firm* — Xsensus LLP

(57) ABSTRACT

A liquid discharge apparatus includes a housing, a holder configured to hold a medium, a heater configured to heat the medium held by the holder, and a liquid discharge head configured to discharge a liquid onto the medium held by the holder. The holder has a flat holding surface on which the medium is placed flat, the holder is movable in the housing in a direction parallel to the flat holding surface and in a vertical direction, and the heater is disposed inside the housing within a movable region of the holder in which the holder is movable in the direction parallel to the flat holding surface in a view from the vertical direction.

11 Claims, 4 Drawing Sheets

(56) References Cited

U.S. PATENT DOCUMENTS

| | | | | |
|---|---|---|---|---|
| 2011/0242189 | A1* | 10/2011 | Okada | D06P 5/30 347/20 |
| 2013/0100218 | A1* | 4/2013 | Iijima | B41J 11/00214 347/102 |
| 2015/0273866 | A1* | 10/2015 | Sakai | B41J 11/002 347/21 |
| 2015/0273868 | A1* | 10/2015 | Vodopivec | B41J 11/00214 347/102 |
| 2018/0105979 | A1 | 4/2018 | Matsumoto | |
| 2018/0361761 | A1 | 12/2018 | Okeguchi et al. | |

FOREIGN PATENT DOCUMENTS

| | | |
|---|---|---|
| JP | 2016-112766 | 6/2016 |
| JP | 2017-094672 A | 6/2017 |
| JP | 2018-066097 | 4/2018 |

* cited by examiner

LIQUID DISCHARGE APPARATUS

CROSS-REFERENCE TO RELATED APPLICATION

This patent application is based on and claims priority pursuant to 35 U.S.C. § 119(a) to Japanese Patent Application No. 2018-176949, filed on Sep. 21, 2018 in the Japan Patent Office, the entire disclosure of which is hereby incorporated by reference herein.

BACKGROUND

Technical Field

Aspects of the present disclosure relate to a liquid discharge apparatus.

Related Art

An inkjet recording apparatus (inkjet printer) as an example of a liquid discharge apparatus has advantages such as low noise, low running cost, and easily printing color. Thus, the inkjet recording apparatus is widely used as a digital-signal output device.

The inkjet recording apparatus is also applied to printing on a medium such as a cloth. Recently, market size in so-called Direct to Garment (DTG) field has been increasing year by year. The DTG directly prints on clothing such as T-shirts. Further, an image formed on a cloth or the like by an inkjet method is needed to have an image quality equivalent to an image quality of conventional analog printing. Thus, an apparatus capable of preventing a deterioration in print quality is needed.

SUMMARY

In an aspect of this disclosure, a liquid discharge apparatus includes a housing, a holder configured to hold a medium, a heater configured to heat the medium held by the holder, and a liquid discharge head configured to discharge a liquid onto the medium held by the holder. The holder has a flat holding surface on which the medium is placed flat. The holder is movable in the housing in a direction parallel to the flat holding surface and in a vertical direction. The heater is disposed inside the housing within a movable region of the holder in which the holder is movable in the direction parallel to the flat holding surface in a view from the vertical direction.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
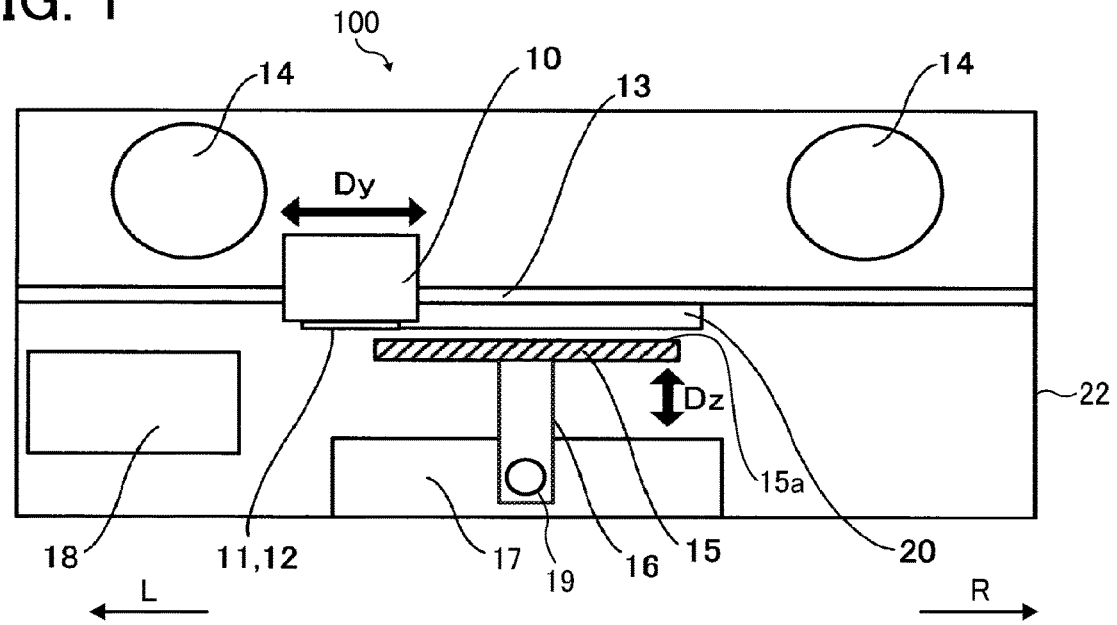
FIG. 1 is a schematic front view of a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Hereinafter, embodiments of a liquid discharge apparatus 100 according to the present disclosure is described with reference to the drawings. Note that the present disclosure is not limited to the following embodiments and may be other embodiments.

The following embodiments may be modified by, e.g., addition, modification, or omission within the scope that would be obvious to one skilled in the art. Any aspects having advantages as described for the following embodiments according to the present disclosure are included within the scope of the present disclosure.

Figure 4:
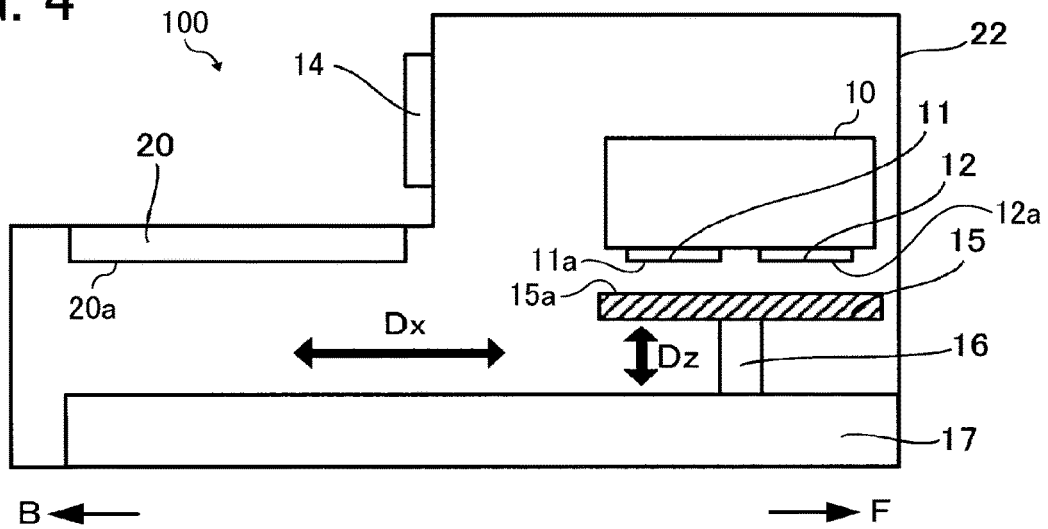
FIG. 4 is a schematic side view of the liquid discharge apparatus according to the embodiment of the present disclosure.

The liquid discharge apparatus 100 according to the present disclosure includes a holder 15 having a flat holding surface 15*a* to hold a medium 30 (see FIGS. 7A to 7C), a heater 20 to heat the medium 30 held by the holder 15 (see FIG. 6), and liquid discharge heads 11 and 12 to discharge a liquid to the medium 30 held by the holder 15 (see FIG. 4). The holder 15 includes a plate defining a flat holding surface 15*a* on which the medium 30 is placed flat. The flat holding surface 15*a* is a flat surface so that the medium 30 placed on the flat holding surface 15*a* has a flat surface on which the liquid is discharged. The holder 15 is not limited to the plate and may be a belt having a flat surface.

The holder 15 is movable in a direction substantially parallel to the flat holding surface 15*a* (in a horizontal direction) and in a vertical direction inside the liquid discharge apparatus 100.

The heater 20 is arranged at a position overlapping a movement range of the holder 15 in a direction substantially parallel to the holder 15 when viewed from the direction substantially perpendicular to the flat holding surface 15*a*. Further, the heater can contact the flat holding surface 15*a* of the holder 15.

The holder 15 can move in a direction approaching the heater 20 after moving downward from the heater 20 while holding the medium 30 on the flat holding surface 15*a*.

Further, the holder 15 moves in a substantially horizontal direction from a position at which the flat holding surface 15*a* faces nozzle surfaces 11*a* and 11*b* (see FIG. 4) of the liquid discharge heads 11 and 12 to a position at which the flat holding surface 15*a* faces the heater 20. Then, the holder 15 moves in a substantially vertical direction to a position at which the flat holding surface 15*a* is adjacent to or in contact with the heater 20.

An example of the configuration of the liquid discharge apparatus 100 according to the present disclosure is described with reference to FIGS. 1 to 3.

Figure 2:
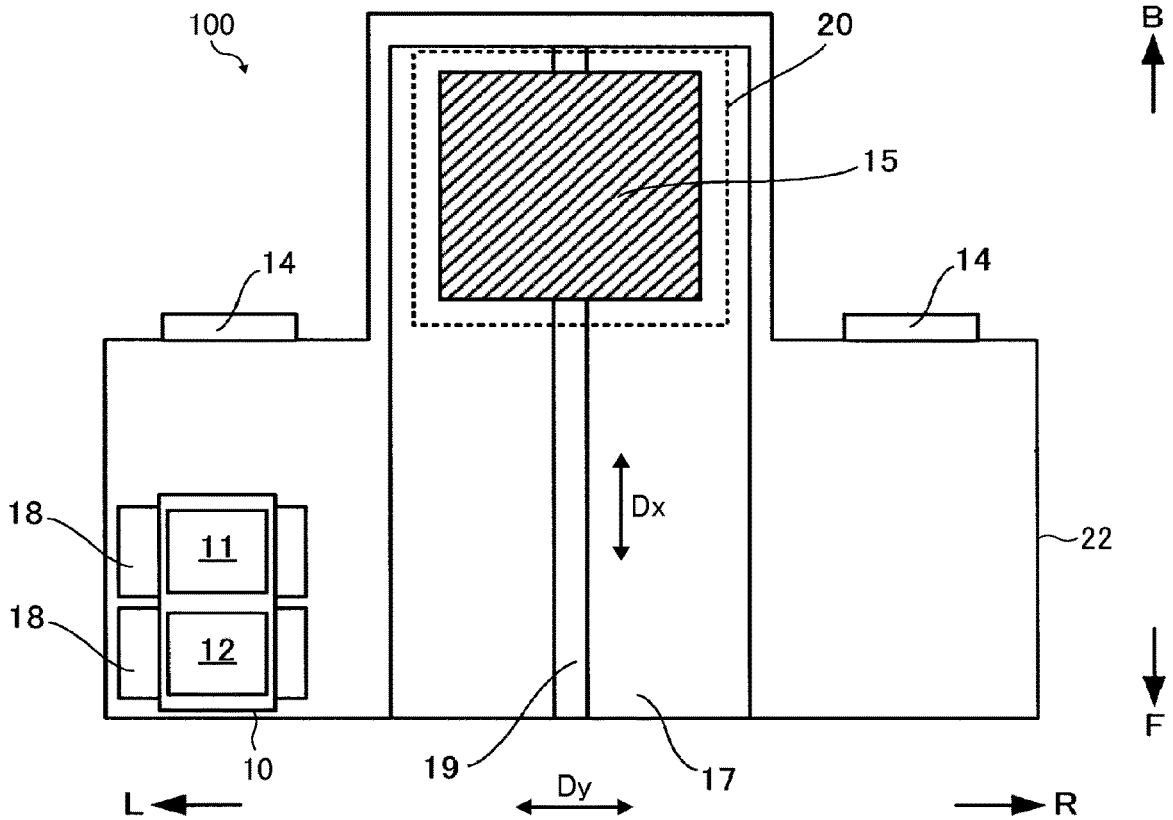
FIG. 2 is a schematic top view of the liquid discharge apparatus according to the embodiment of the present disclosure.

A medium 30 is conveyed in a backward direction indicated by arrow "B" in FIG. 2 or in a forward direction indicated by arrow "F" in FIG. 2. FIG. 1 is a schematic cross-sectional view (front view) in a main scanning direction indicated by arrow Dy in FIG. 1. The main scanning direction Dy is perpendicular to a direction of conveyance of the medium 30 indicated by arrow Dx in FIGS. 2 and 3. Hereinafter, the "direction of conveyance of the medium" is simply referred to as a "medium conveyance direction" or a "sub-scanning direction".

Figure 3:
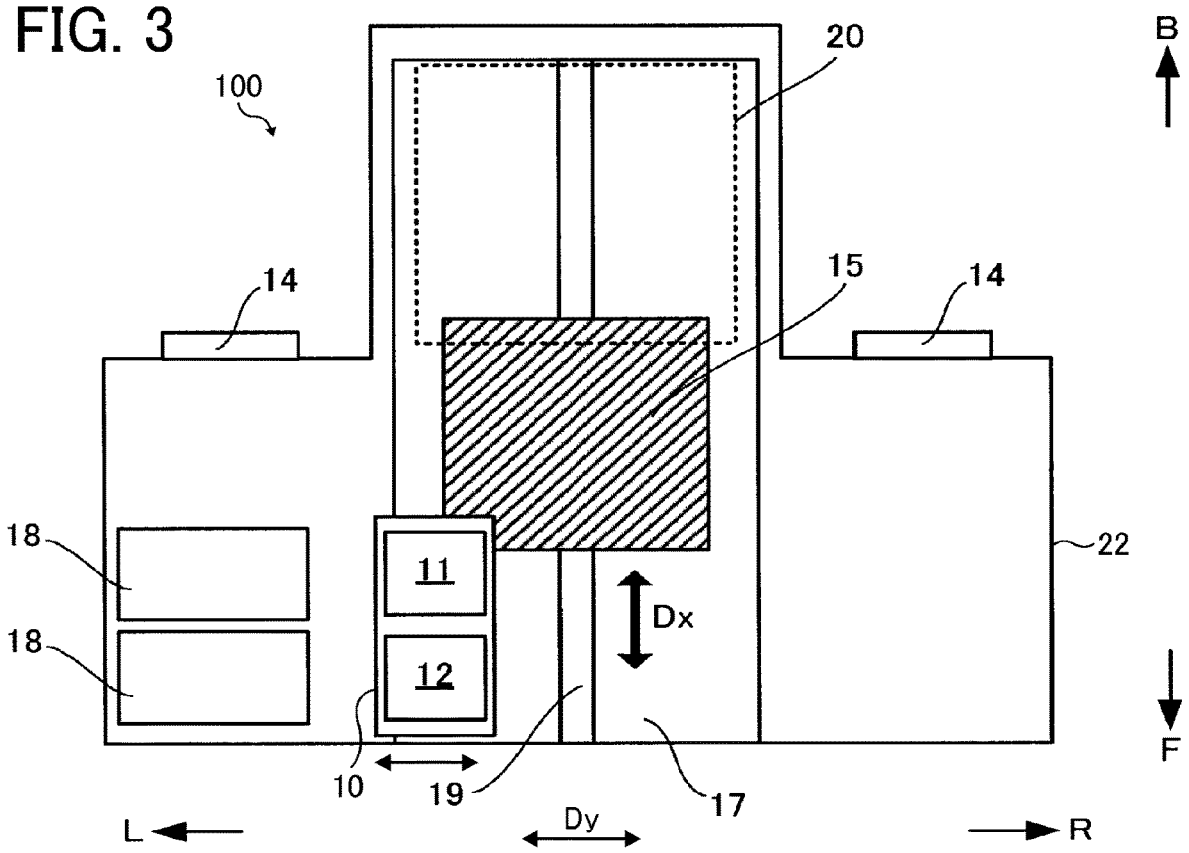
FIG. 3 is a schematic top view of the liquid discharge apparatus according to the embodiment of the present disclosure.

FIGS. 2 and 3 are schematic cross-sectional view (top view) in the sub-scanning direction Dx. In FIGS. 2 and 3, the medium 30 is conveyed between a front part of the liquid discharge apparatus 100 indicated by "F" and a rear part of the liquid discharge apparatus 100 indicated by "B" in the sub-scanning direction Dx.

FIGS. 1 to 3 illustrate a carriage 10, a first liquid discharge head 11, a second liquid discharge head 12, a carriage scanning rail 13, an exhaust 14, a holder 15, a support 16 to support the holder 15, and a holder moving stage 17, a maintenance unit 18, and a heater 20. Hereinafter, the liquid discharge head is also simply referred to as the "head". The carriage scanning rail 13 is a first guide arranged along the main scanning direction Dy. The carriage 10 moves along the carriage scanning rail 13 in the main scanning direction Dy.

FIGS. 2 and 3 indicates the position of the heater 20 by a broken line. The medium 30 is placed on the flat holding surface 15*a* of the holder 15.

The carriage 10 is movable in a direction of movement of the carriage 10 (main scanning direction) indicated by Dy in FIG. 1. The direction of movement of the carriage 10 is also referred to as "carriage movement direction". The holder 15 is movable in a direction of movement of the holder 15 (vertical direction) indicated by Dz in FIG. 1. The direction of movement of the holder 15 is also referred to as "holder movement direction".

The holder 15 holds the medium 30, and the size and the like of the holder 15 can be appropriately changed. Examples of the medium 30 include, but are not limited to, a fabric such as a T-shirt. For example, plain paper, gloss paper, and special paper may be used as the medium 30. Also, impermeable substrates may be used to form good quality images. Further, ceramics, glass, metal, or the like can be used by adjusting configuration of the path along which the medium 30 is conveyed. Specific examples of the medium 30 include cloth for apparel such as T-shirts, textiles, leather, etc., and building materials such as wallpaper, flooring, and tiles.

The holder 15 is supported by a support 16. The holder moving stage 17 is a mechanism to move the holder 15. The holder 15 is movable in a direction substantially parallel to and perpendicular to the flat holding surface 15*a* inside the liquid discharge apparatus 100. The holder 15 moves along a holder moving rail 19 in a sub-scanning direction indicated by Dx in FIGS. 2 and 3 and also moves in a vertical direction indicated by Dz in FIG. 1. The holder 15 may also move in the main scanning direction Dy, the sub-scanning direction Dx, and the vertical direction Dz. The holder moving rail 19 is a second guide arranged along the sub-scanning direction Dx. The holder 15 moves along the holder moving rail 19 in the sub-scanning direction Dx.

The holder moving stage 17 moves the holder 15 in the vertical direction Dz to adjust a distance (gap) between the heads 11 and 12 and the medium 30. The holder moving stage 17 according to the present disclosure also adjust a distance between heads 11 and 12 and the heater 20. Thus, it is not necessary to provide a mechanism to move the heater 20 in the liquid discharge apparatus 100. Thus, the holder moving stage 17 can reduce size and cost of the liquid discharge apparatus 100.

A specific example of movement of the holder 15 is described below.

In a configuration in which a heater (heating device) is provided separately from a liquid discharge apparatus, a heated part of the heater is often exposed outside the liquid discharge apparatus 100. Thus, the user may touch the heater 20 to get burned.

Conversely, the liquid discharge apparatus 100 according to the present disclosure includes the heater 20 built inside the liquid discharge apparatus 100. Thus, a heated part of the heater 20 is not exposed outside the liquid discharge apparatus 100. Thus, the liquid discharge apparatus 100 according to the present disclosure can reduce the risk of the user to contact the heater 20.

Further, the heater 20 is disposed in a region away from the user's operation region such as a rea side (indicated by arrow "B" in FIGS. 2 and 3) of the liquid discharge apparatus 100 in the sub-scanning direction Dx (in the direction parallel to the flat holding surface 15*a*). Thus, the liquid discharge apparatus 100 can secure safety of the user and remove uncomfortable feelings caused by direct contact with hot air generated from the heater 20.

In FIG. 4, the heater 20 is attached on an inner upper surface of a housing 22 so that the flat holding surface 15*a* of the holder 15 is disposed below the heater 20. Thus, the holder 15 ascends toward the heater 20 to bring the medium 30 closed to or in contact with the heater 20.

Further, the heater 20 is disposed in a region apart and separated from the heads 11 and 12 in the sub-scanning direction Dx (in the direction parallel to the flat holding surface 15*a*). Thus, the liquid discharge apparatus 100 can reduce occurrence of problems such as deterioration or hardening of ink in the heads 11 and 12 and reduce problems such as clogging of nozzles of the heads 11 and 12 due to heat generated from the heater 20.

The heater 20 is disposed apart and separated from the heads 11 and 12, etc in the sub-scanning direction Dx. The heater 20 is disposed at a position at which the heater 20 is contactable with the flat holding surface 15*a* of the holder 15.

Further, the heater 20 is disposed in a region separated from the heads 11 and 12 in the sub-scanning direction Dx along the holder moving rail 19 (second guide).

Thus, the heater is disposed inside the housing 22 within a movable region of the holder 15 in which the holder 15 is movable in a direction parallel to the flat holding surface 15*a* in a view from the vertical direction Dz. The direction parallel to the flat holding surface 15*a* includes the main scanning direction Dy and the sub-scanning direction Dx.

The heater 20 is preferably, for example, a mica heater or a silicon rubber heater. Since the silicon rubber heater heats the medium 30 with rubber having a flexible surface, a flat plate, such as a sheet metal, is preferably disposed on a surface of the heater 20 to heat the medium 30. Fluorine resin processing or water repellent processing is preferably performed on the cloth-side surface of the flat plate to prevent adhesion of liquid.

Further, a position of the surface of the heater 20 facing the holder 15 and a position of a surface of the heads 11 and 12 facing the holder 15 in the vertical direction Dz are preferably substantially the same.

Thus, the liquid discharge apparatus 100 can reduce a range of movement of the holder 15 in the vertical direction Dz to a minimum and also reduce time for moving and adjusting the holder 15.

The maintenance unit 18 maintains the heads 11 and 12 and includes a cap, a suction pump, a dummy discharge receptacle, and the like.

The carriage 10 is a housing on which the heads 11 and 12 are mounted. Here, the head 11 is also referred to as a first liquid discharge head 11, and the head 12 is also referred to as a second liquid discharge head 12. In addition to the heads 11 and 12, an encoder sensor, a moving belt, an elevation mechanism and the like are also attached to the carriage 10.

The carriage scanning rail 13 is a rail to guide the carriage 10 to move in the main scanning direction Dy perpendicular to the sub-scanning direction Dx in FIG. 1.

The first liquid discharge head 11 may discharge a pretreatment liquid, and the second liquid discharge head 12 may discharges ink, for example.

When the first liquid discharge head 11 and the second liquid discharge head 12 are described without distinction, the first liquid discharge head 11 and the second liquid discharge head 12 are simply referred to as "heads 11 and 12".

FIG. 3 is a schematic top view of the liquid discharge apparatus 100 illustrating a state in which the carriage 10 and the holder 15 in FIG. 2 are moved.

The holder 15 moves along the holder moving rail 19 in a direction indicated by arrow "Dx" in FIG. 3. Since the medium 30 moves while being held on the holder 15, the holder 15 and the medium 30 move in the same direction.

Further, the second liquid discharge head 12 is disposed downstream of the first liquid discharge head 11 in the sub-scanning direction Dx as indicated by arrow "F" in FIG. 3.

The holder 15 moves in the sub-scanning direction Dx in FIGS. 2 and 3. When the holder 15 approaches the carriage 10 to a position facing the carriage 10, the heads 11 and 12 discharge the liquid onto the medium 30 held by the holder 15 while the carriage 10 scans in the main scanning direction Dy.

A position of the medium 30 (holder 15) may be fixed and the carriage 10 may reciprocally move back (B) and forth (F) in the sub-scanning direction Dx. In FIGS. 2 and 3, the backward direction (B) corresponds to an upstream direction in the sub-scanning direction Dx, and the forward direction (F) corresponds to a downstream direction in the sub-scanning direction Dx.

The medium 30 is conveyed (reciprocally moved back and forth) in the sub-scanning direction Dx indicated by arrow "backward (B)" and "forward (F)" in FIG. 3.

Further, the carriage 10 (heads 11 and 12) may reciprocally move (scan) in the sub-scanning direction Dx indicated by arrow "backward (B)" and "forward (F)" in FIG. 3. The "upstream direction" in the sub-scanning direction Dx corresponds to the backward direction (B) in FIGS. 2 and 3. The "downstream direction" in the sub-scanning direction Dx corresponds to the forward direction (F) in FIGS. 2 and 3. Thus, an "upstream side" corresponds to the backward (B) side in the sub-scanning direction Dx, and a "downstream side" corresponds to the forward (F) side in the sub-scanning direction Dx in FIG. 3.

The heads 11 and 12 discharges the liquid such that the first liquid discharge head 11 discharges the pretreatment liquid onto the medium 30 first liquid discharge head 11 and the second liquid discharge head 12 discharge the ink onto the medium 30 next, for example.

The pretreatment liquid is not limited to any particular material as long as the pretreatment liquid is dischargeable from the heads 11 and 12 and may be selected from known pretreatment liquids. The pretreatment liquid preferably contains a polyvalent metal ion. The pretreatment liquid may optionally include other constituents such as a resin, for example.

The polyvalent metal ion can be appropriately selected from known polyvalent metal ions. Specific examples of the polyvalent metal ion include, but are not limited to, calcium ion, magnesium ion, and aluminum ion, for example. One type of the polyvalent metal ion may be used alone, or two or more types of the polyvalent metal ions may be used in combination.

A water-soluble polyvalent metal salt may be dissolved into the pretreatment liquid to prepare the pretreatment liquid containing the polyvalent metal ion.

The polyvalent metal salt can be appropriately selected from known polyvalent metal salts. For example, carboxylates (acetic acid, lactic acid, etc.), sulfates, nitrates, chlorides, and thiocyanates are suitable. One type of the polyvalent metal salt may be used alone, or two or more types of the polyvalent metal salts may be used in combination. Among the polyvalent metal salts, carboxylates, sulfates, nitrates, and chlorides that have good solubility in water and water-soluble organic solvents are preferable from the viewpoints of image quality such as color developability and bleeding resistance, and discharge reliability.

The ink is not limited to any particular ink as long as the ink is dischargeable from the heads 11 and 12 and may be selected from known inks. For example, the ink may contain an organic solvent, water, a colorant, resin, an additive, etc.

There is no specific limitation on the type of the organic solvent. For example, water-soluble organic solvents can be used. Examples of the organic solvent may include ethers such as polyols, polyol alkyl ethers, and polyol aryl ethers, nitrogen-containing heterocyclic compounds, amides, amines, and sulfur-containing compounds.

Examples of the colorant include, but are not limited to, pigments and dyes.

Usable pigments include both inorganic pigments and organic pigments. One type of pigment can be used alone, or two or more types of pigments can be used in combination. Mixed crystals can also be used as the colorant. Usable pigments include black pigments, yellow pigments, magenta pigments, cyan pigments, white pigments, green pigments, orange pigments, glossy color pigments (e.g., gold pigments and silver pigments), and metallic pigments.

The dyes are not particularly limited, and acid dyes, direct dyes, reactive dyes, and basic dyes can be used. Each of dyes can be used alone or in combination with other dyes.

The pigment can be dispersed in the ink by any of the following methods: introducing a hydrophilic functional group to the pigment to make the pigment self-dispersible;

covering the surface of the pigment with a resin; and dispersing the pigment by a dispersant.

The ink can be obtained by mixing a pigment with other materials such as water and an organic solvent. The ink can also be obtained by, first, preparing a pigment dispersion by mixing a pigment with water, a dispersant, etc., and mixing the pigment dispersion with other materials such as water and an organic solvent after preparing the pigment dispersion.

The pigment dispersion can be obtained by mixing water, a pigment, a pigment dispersant, and other components, if necessary, to disperse the pigment, and adjusting the particle diameter of the pigment. Preferably, the pigment dispersion is prepared with a disperser.

Types of the resin contained in the ink is not particularly limited and may be appropriately selected according to the purpose. Specific examples the resin contained in the ink include urethane resins, polyester resins, acrylic resins, vinyl acetate resins, styrene resins, butadiene resins, styrene-butadiene resins, vinyl chloride resins, acrylic styrene resins, and acrylic silicone resins.

Resin particles made of the above-described resins may also be used. The resin particles may be dispersed in water as a dispersion medium to prepare a resin emulsion. The ink can be obtained by mixing the resin emulsion with other materials such as a colorant and an organic solvent. The resin particles are available either synthetically or commercially. The resin particles may include one type or two or more types of resin particles.

Examples of additives include surfactants, defoamer, a preservative, a fungicide, an anticorrosive, pH adjuster, and the like.

Further, an aftertreatment liquid can be applied to the medium 30 as needed.

The aftertreatment liquid is not particularly limited as long as the aftertreatment liquid can form a transparent layer. The aftertreatment liquid may be obtained by mixing at least one of an organic solvent, water, a resin, a surfactant, a defoamer, a pH adjuster, a preservative, a fungicide, and an anticorrosive. The aftertreatment liquid may be applied to the entire recording area formed on the medium 30 or may be applied only to an area of the medium 30 on which the ink image is formed.

The exhaust 14 is a mechanism to exhaust gas in the housing 22 out of the housing 22. For example, the exhaust 14 may include a fan. Specifically, the exhaust 14 may include a fan connected to the motor, for example.

To reduce influence of heat on the heads 11 and 12, the exhaust 14 is preferably disposed between the heads 11 and 12 and the heater 20 in the sub-scanning direction Dx (see FIGS. 3 and 4). Thus, the heat from the heater 20 is difficult to transferred to the heads 11 and 12.

Next, movement of the holder 15 is described with reference to FIGS. 4 to 7.

Figure 5:
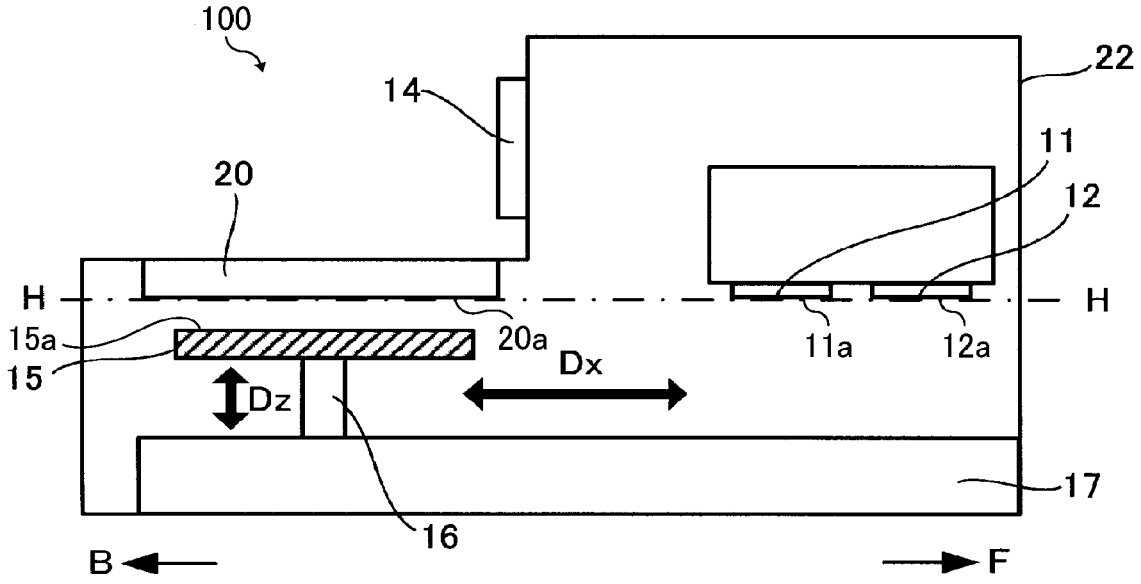
FIG. 5 is a schematic side view of the liquid discharge apparatus according to the embodiment of the present disclosure.
Figure 6:
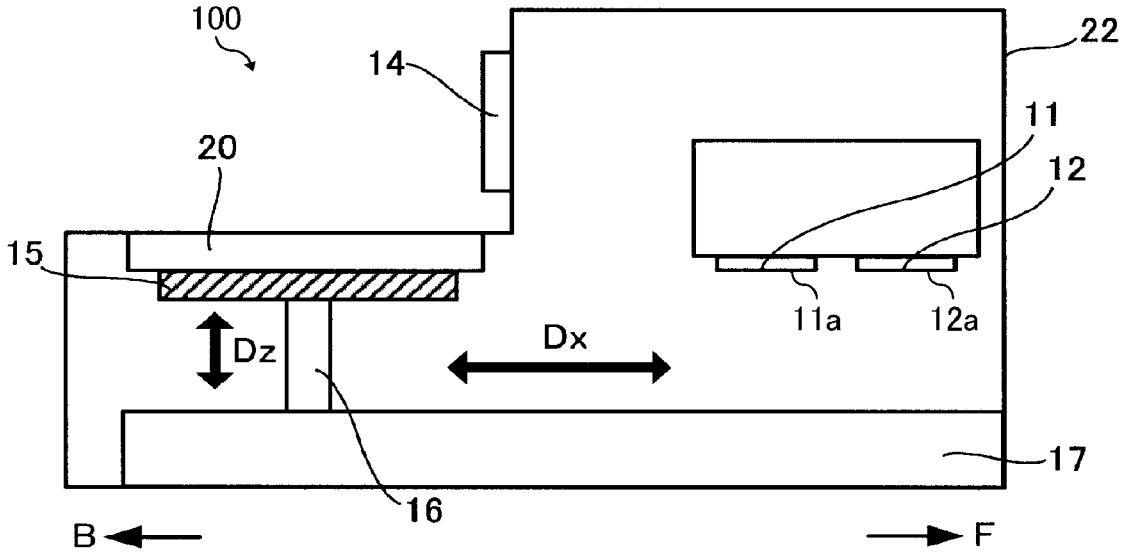
FIG. 6 is a schematic side view of the liquid discharge apparatus according to the embodiment of the present disclosure.

FIGS. 4 to 6 are side views of the liquid discharge apparatus 100 according to the present disclosure (left side surface in FIGS. 1 to 3).

FIG. 4 illustrates a position of the holder 15 after the liquid is discharged onto the medium 30 (after printing). FIG. 5 illustrates a position of the holder 15 before a heat treatment is applied on the medium 30. FIG. 6 illustrates a position of the holder 15 during the heat treatment is applied on the medium 30.

Figure 7A:
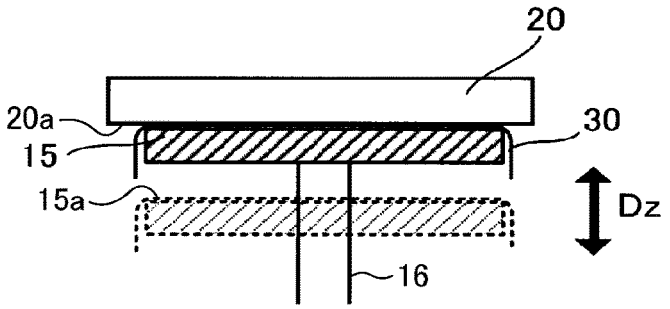
FIGS. 7A to 7C are enlarged side views of a holder and a heater during a heat treatment of a medium.
Figure 7B:
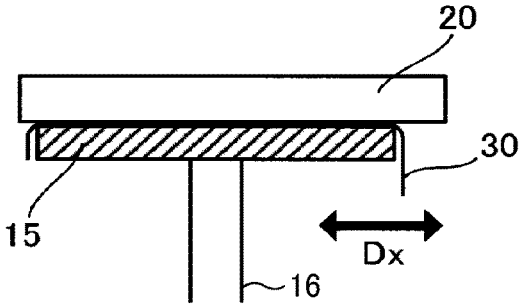
Figure 7C:
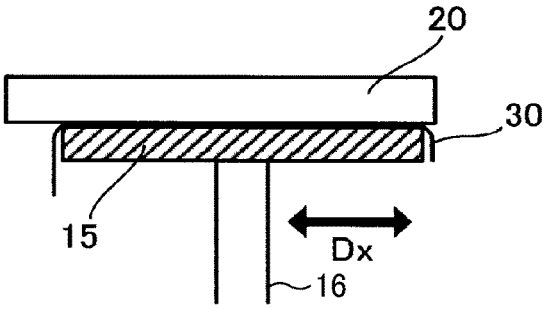

FIGS. 7A to 7C are enlarged views of the holder 15 and the heater 20 during the heat treatment of the medium 30.

As illustrated in FIGS. 4 and 5, the holder 15 moves downward below the heater 20 while holding the medium 30 on the flat holding surface 15*a*, and then moves in a direction (upward) approaching the heater 20.

Further, the holder 15 moves in a substantially horizontal direction along the sub-scanning direction Dx from a position at which the flat holding surface 15*a* of the holder 15 faces the nozzle surfaces 11*a* and 12*a* of the heads 11 and 12 (see FIG. 4) to a position at which the flat holding surface 15*a* of the holder 15 faces the heater 20 (see FIG. 5). The heads 11 and 12 includes the nozzle surfaces 11*a* and 12*a*, respectively, on which nozzles are formed. The heads 11 and 12 discharge the liquid from the nozzles on the nozzle surfaces 11*a* and 12*a*, respectively. Then, the holder 15 moves in a substantially vertical direction Dz to a position at which the flat holding surface 15*a* is adjacent to or in contact with the heater 20 (see FIG. 6).

As illustrated in FIG. 5, a surface of the heater 20 and the nozzle surfaces 11*a* and 12*a* of the heads 11 and 12 facing the flat holding surface 15*a* of the holder 15 are disposed at substantially the same height (indicated by "H" in FIG. 5) in the vertical direction Dz.

The holder 15 presses the medium 30 against the heater 20 before the heads 11 and 12 discharges the liquid onto the medium 30.

Further, the holder 15 brings the medium 30, onto which the liquid has been discharged, close to the heater 20 or into contact with the heater 20.

Here, "press" means a state in which the medium 30 is sandwiched between the heater 20 and the flat holding surface 15*a* of the holder 15 so that a certain amount of pressure is applied to the medium 30. "Contact" means a state in which the medium 30 is sandwiched between the heater 20 and the flat holding surface 15*a* of the holder 15 so that a pressure weaker than the above-described "press" is applied on the medium 30. Further, "close to" or "approach" means a state in which the medium 30 is in a non-contact state with a heating surface 20*a* of the heater 20 with a certain distance between the medium 30 and the heating surface 20*a* of the heater 20.

When the medium 30 is a fabric, the heat treatment is performed not only after printing but also before printing.

With the heat treatment before printing, the fabric can be prevented from fluffing, and wrinkles can be removed from the fabric.

In the heat treatment after printing, it is preferable to heat the medium 30 with a gap of few millimeters between the medium 30 and the heating surface 20*a* of the heater 20 so that the medium 30 does not contact the heating surface 20*a* of the heater 20 to prevent the liquid on the medium 30 from bleeding and prevent the heating surface 20*a* of the heater 20 from being soiled.

The holder 15 on which the medium 30 is placed ascends in the vertical direction Dz as in FIG. 7A to bring the medium 30 in contact with the heater 20 and press the medium 30 against the heater 20.

Further, as in FIGS. 7B and 7C, the holder 15 preferably moves the medium 30 within a region facing the heater 20 while pressing the medium 30 against the heater 20. Thus, the medium 30 is moved in the sub-scanning direction Dx in FIGS. 7B and 7C. Thus, the liquid discharge apparatus 100 can efficiently remove wrinkles from the medium 30 in a manner of ironing.

A flow of printing on a fabric as the medium 30 using the liquid discharge apparatus according to the present disclosure is described below.

First, the holder 15 holding the fabric as the medium 30 descends below the heater 20 and then ascends to press the medium 30 (fabric) against the heater 20 with a predetermined pressing pressure.

The heater 20 generates heat at a predetermined temperature during the heat treatment of the medium 30. Thus, the heater 20 heats the medium 30 pressed against the heater 20.

The holder 15 moves within a region facing the heater 20 while bringing the medium 30 in contact with the heater 20 and pressing the medium 30 against the heater 20 to remove the wrinkles from the medium 30.

After the heat treatment for a predetermined time, the holder 15 descends to separate the medium 30 from the heater 20. Further, moisturized water is preferably applied to the medium 30 before the heat treatment.

Next, the holder 15 moves in the sub-scanning direction Dx to a position facing the nozzle surfaces 11*a* and 12*a* of the heads 11 and 12 while holding the medium 30. Then, the holder 15 ascends toward the nozzle surfaces 11*a* and 12*a* of the heads 11 and 12 to a position at which a predetermined gap is formed between the flat holding surface 15*a* of the holder 15 and the nozzle surfaces 11*a* and 12*a* of the heads 11 and 12. Then, the heads 11 and 12 discharge the liquid onto the medium 30 while the carriage 10 scans (reciprocally moves) in the main scanning direction Dy and the holder 15 scans (reciprocally moves) in the sub-scanning direction Dx to perform printing on the medium 30.

Then, the holder 15 moves below the heater 20 in the sub-scanning direction Dx while holding the medium 30 on which the image is printed and ascends to a position close to or in contact with the heater 20.

The holder 15 descends after the heater 20 heats the medium 30 on which the image is printed for a predetermined time.

In the heat treatment after printing, the medium 30 is preferably not pressed against the heater 20, and the heater 20 preferably heats the medium 30 without contacting the medium 30. Thus, the liquid discharge apparatus 100 can reduce the soil attached on a printing surface of the medium 30 and reduce damage onto the medium 30. However, the heater 20 may also heat the medium 30 while the medium is pressed against the heater 20 with a weak pressing pressure.

The liquid discharge apparatus 100 according to the present disclosure can perform the heat treatment on the medium such as fabric inside the housing 22 while reducing the size and the cost of the liquid discharge apparatus 100. The heat treatment dries and fixes the liquid discharged onto the medium 30 and also removes the wrinkles from the medium 30.

In addition, since the drying and fixing steps are completed in the apparatus, workability when an image is applied to a medium such as fabric can be improved.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A liquid discharge apparatus comprising:

a housing;

a holder configured to hold a medium;

a heater configured to heat the medium held by the holder;

a liquid discharge head configured to discharge a liquid onto the medium held by the holder; and an exhaust configured to exhaust gas in the housing, wherein the holder has a flat holding surface on which the medium is placed flat, the holder is movable in the housing in a direction parallel to the flat holding surface and in a vertical direction, the heater is disposed inside the housing within a movable region of the holder in which the holder is movable in the direction parallel to the flat holding surface in a view from the vertical direction, and the entire exhaust is disposed between the liquid discharge head and the heater in the direction parallel to the flat holding surface, and at a same side of the flat holding surface as the liquid discharge head.

2. The liquid discharge apparatus according to claim 1, wherein the holder is configured to:

move below the heater in the direction parallel to the flat holding surface while the holder holds the medium on the flat holding surface; and move toward the heater in the vertical direction while the holder holds the medium on the flat holding surface.

3. The liquid discharge apparatus according to claim 1, wherein the holder is movable in the direction parallel to the flat holding surface between a position at which the flat holding surface faces the liquid discharge head to a position at which the flat holding surface faces the heater.

4. The liquid discharge apparatus according to claim 1, wherein the holder is configured to:

press the medium to the heater before the liquid is discharged onto the medium; and move the medium close to the heater to a position at which a predetermined gap is formed between the heater and medium to heat the medium after the liquid is discharged onto the medium.

5. The liquid discharge apparatus according to claim 1, wherein the holder is configured to:

press the medium to the heater before the liquid is discharged onto the medium; and move the medium to bring the medium in contact with the heater to heat the medium.

6. The liquid discharge apparatus according to claim 1, wherein the holder is configured to move the medium within a region facing the heater while pressing the medium against the heater.

7. The liquid discharge apparatus according to claim 1, wherein a position of a surface of the heater facing the holder and a position of a surface of the liquid discharge head facing the holder are same in the vertical direction.

8. The liquid discharge apparatus according to claim 1, wherein the heater is attached on an inner upper surface of the housing, and the flat holding surface of the holder is disposed below the heater in the housing.

9. The liquid discharge apparatus according to claim 1, wherein the heater is disposed in a region separated from the liquid discharge head in the direction parallel to the flat holding surface.

10. The liquid discharge apparatus according to claim 1, wherein the liquid discharge head includes:

a first liquid discharge head configured to discharge a pretreatment liquid; and a second liquid discharge head configured to discharge ink.

11. The liquid discharge apparatus according to claim 1, further comprising:

a first guide along which the liquid discharge head moves in a main scanning direction; and a second guide along which the holder moves in a sub-scanning direction perpendicular to the main scanning direction, wherein the heater is disposed in a region separated from the liquid discharge head in the sub-scanning direction along the second guide.

* * * * *